US007419554B2

(12) United States Patent
Eriksson et al.

(10) Patent No.: US 7,419,554 B2
(45) Date of Patent: Sep. 2, 2008

(54) ENGINE CYLINDER BLOCK AND CYLINDER HEAD FABRICATED FROM A GREY CAST IRON ALLOY

(75) Inventors: Kent Eriksson, Skovde (SE); Tony Liu, Skovde (SE); Berndt Gyllensten, Skovde (SE); Johan Oberg, Skovde (SE)

(73) Assignee: Volvo Lastvagnar AB, Gothenburg (SE)

( * ) Notice: Subject to any disclaimer, the term of this patent is extended or adjusted under 35 U.S.C. 154(b) by 0 days.

(21) Appl. No.: 11/162,676

(22) Filed: Sep. 19, 2005

(65) Prior Publication Data

US 2006/0008377 A1 Jan. 12, 2006

Related U.S. Application Data

(63) Continuation of application No. PCT/SE2004/000139, filed on Feb. 2, 2004, now abandoned.

(30) Foreign Application Priority Data

Mar. 19, 2003 (SE) ..... 0300752

(51) Int. Cl.
*C22C 37/06* (2006.01)
*C22C 37/10* (2006.01)
*C22C 37/00* (2006.01)

(52) U.S. Cl. ..... 148/321; 420/13; 420/26; 420/27

(58) Field of Classification Search ..... 420/9–33; 148/321–323

See application file for complete search history.

(56) References Cited

U.S. PATENT DOCUMENTS

| | | | | | |
|---|---|---|---|---|---|
| 4,435,226 | A | * | 3/1984 | Neuhauser et al. | 148/545 |
| 5,232,041 | A | * | 8/1993 | Kuhn | 164/105 |
| 5,851,014 | A | * | 12/1998 | Germann et al. | 277/406 |
| 5,980,651 | A | * | 11/1999 | de Azevedo et al. | 148/321 |
| 7,083,685 | B1 | * | 8/2006 | Katori et al. | 148/321 |

FOREIGN PATENT DOCUMENTS

| | | | |
|---|---|---|---|
| JP | 408311599 | * | 11/1996 |
| JP | 2000104138 | A | 4/2000 |
| JP | 2001207218 | A | 7/2001 |
| SU | 1036787 | A | 8/1983 |
| SU | 1310451 | * | 5/1987 |

OTHER PUBLICATIONS

English abstract of Japanese patent 03238157, Oct. 23, 1991.*
International Search Report dated Jun. 16, 2004 for International Patent Application PCT/SE2004/000139.
Atkins, Christopher F.C., "Nitrogen in Iron," Foundry World, Fall 1979, pp. 43-50.

* cited by examiner

*Primary Examiner*—Deborah Yee
(74) *Attorney, Agent, or Firm*—Novak, Druce + Quigg LLP

(57) ABSTRACT

A grey cast iron alloy for producing cylinder block and/or cylinder head castings including iron, carbon, silicon, manganese, phosphorus, sulphur, tin, copper, chromium, molybdenum and nitrogen. The nitrogen content of the alloy is in the range of 0.0095-0.016 percent.

18 Claims, 1 Drawing Sheet

ENGINE CYLINDER BLOCK AND CYLINDER HEAD FABRICATED FROM A GREY CAST IRON ALLOY

CROSS-REFERENCE TO RELATED APPLICATIONS

The present application is a continuation patent application of International Application No. PCT/SE2004/000139 filed 02 Feb. 2004 which was published in English pursuant to Article 21(2) of the Patent Cooperation Treaty, and which claims priority to Swedish Application No. 0300752-3 filed 19 Mar. 2003. Said applications are expressly incorporated herein by reference in their entireties.

TECHNICAL FIELD

The present invention relates to a grey cast iron alloy for producing cylinder blocks and/or cylinder head castings, comprising iron, carbon, silicon, manganese, phosphorus, sulphur, tin and nitrogen. The invention further relates to an internal combustion engine component, cast from a grey cast iron alloy according to the invention as further described herein.

BACKGROUND OF THE INVENTION

Emission requirements imposed by environmental legislation on heavy duty diesel engines continue to become higher and higher. Higher peak cylinder pressure is one of the solutions to reduce emissions. To do so, however, stronger material for the cylinder block and the cylinder head is necessary to stand the high pressure of the engine. To use compacted graphite iron could be one of the solutions, however, one must be prepared for higher product cost and lower thermal conductivity, as well as lower damping capacity in the material.

Continued use of grey iron would be positive in many aspects if its strength could be made high enough. The present invention is a contribution toward this target. The effect of nitrogen on the mechanical properties of grey iron has been discussed since 1950's, see for example J. V. Dawson, L. W. L. Smith and B. B. Bach: BCIRA Journal, 1953,4, (12), 540, and/or F. A. Mountford: The influence of nitrogen on the strength, soundness and structure of grey cast iron: The British Foundryman (1966), April, 141-151—all of which are expressly incorporated herein by reference. Increases of nitrogen content on the order of 0.01% or 100 ppm raise the tensile strength by up to 25%. Nitrogen content could be as high as 150 ppm without problems occurring, though the exact nitrogen determination and measurement at that time is discussable.

It has also been showed, for instance in C. Atkin: Nitrogen in iron. Foundry World, Fall, 1 (1979), 43-50 (also expressly incorporated herein by reference), that an increase in nitrogen content from 40 ppm to 80 ppm can increase tensile strength by 10-20% depending on carbon equivalents. Late during this work, it was reported that increases in nitrogen from 40-50 ppm to 140-150 ppm increased tensile strength by 29% without any defect problems, while foundry verification tests were not so successful, P-E. Persson, L-E. Bjorkegren : Gråjärn med forhojda mekaniska egenskaper, Gjuteriforeningen, 20010409 (also expressly incorporated herein by reference). It should be appreciated that all the above data is for separately cast bars.

Although the positive effect was recognized, there is no report of wide application in practical production. Much of the work has been focused on fighting its negative effect, that is, nitrogen in grey iron commercial castings has been considered as a harmful element forming porosity defects in castings, when the nitrogen content is over 90-100 ppm, see J. M. Greenhill and N. M. Reynolds: Nitrogen defects in iron castings. Foundry Trade Journal, 1981, Jul. 16, 111-122, and International committee of foundry technical association: International atlas of casting defects, AFS, 1993 (also expressly incorporated herein by reference). The defect caused by nitrogen is called fissures, blowholes, pinholes or dispersed shrinkage which is seen after machining. The exact allowed levels depend on base chemical composition, other gas contents, casting geometry and solidification rate. Another reason why its positive effect was not widely used could be that the strength requirement on grey iron so far has been easily fulfilled by adjusting carbon equivalent and adding easily controlled alloy elements. However, further increasing the grey iron strength to levels as required in the future using the conventional methods would cause severe castability problems for foundries. A new route is therefore necessary to overcome the castability problem.

Nitrogen content in grey iron melt is usually in the range of 0.004-0.009%, or 40-90 ppm. The exact contents depend on the charge material and the melting process. Melt from cupola with high percentage of steel scrap has higher nitrogen content than melt from electrical furnace and low percentage of steel scrap. Since the content is in such a low level, control of its content is usually ignored in foundry practice, unless some foundries add titanium to the melt to avoid gas porosity in castings.

What is needed, therefore, is a grey cast iron alloy for producing cylinder block and/or cylinder head castings having more strength than present grey cast iron alloys, with good machinability and with a highly controlled level of nitrogen to avoid scrap.

SUMMARY OF THE INVENTION

The presently disclosed invention(s) answer the above-described need for grey cast iron alloy used to produce cylinder block and/or cylinder head castings, and which have more strength than present grey cast iron alloys, as well as good machinability and a highly controlled level of nitrogen that permits the avoidance of scrap generation. For meeting this object, the present invention provides a grey cast iron alloy for producing cylinder block and/or cylinder head castings according to the teachings of the invention and comprises iron, carbon, silicon, manganese, phosphorus, sulphur, tin and nitrogen, and is characterized by the fact that the nitrogen content of the alloy is in the range of 0.0095-0.0160%, and that the tin content of the alloy is in the range of 0.05-0.15%.

BRIEF DESCRIPTION OF THE DRAWINGS

The invention is further described below, and in a non-limiting way with reference to the accompanying drawings in which.

DETAILED DESCRIPTION OF THE INVENTION

Figure 1:
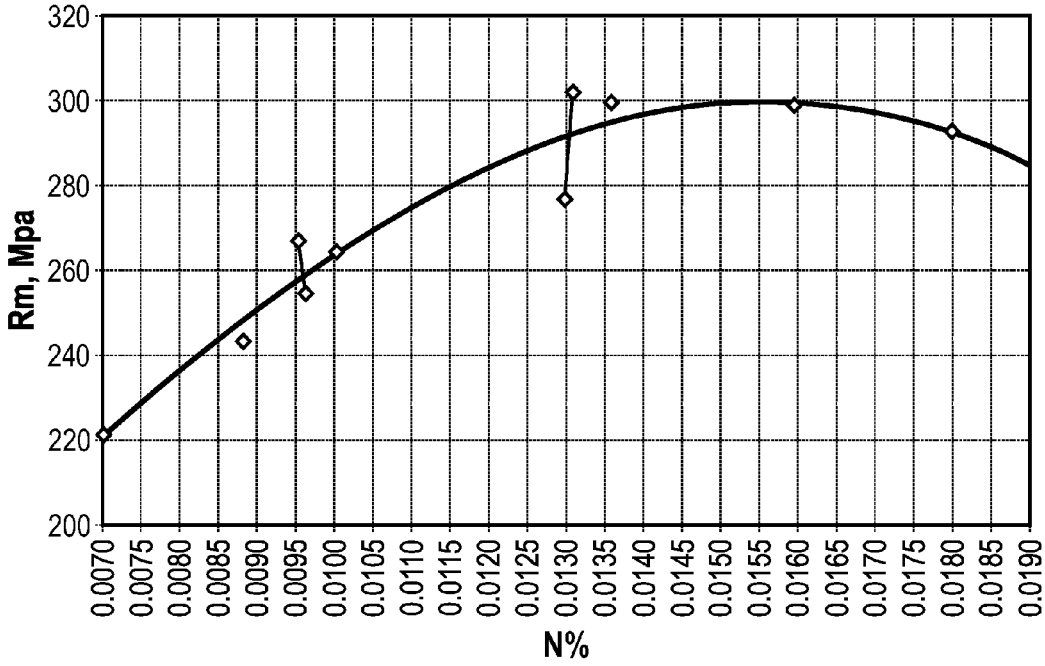
FIG. 1 is a diagram showing the relation between tensile strength and nitrogen content in a grey cast iron alloy.

According to the invention, cylinder heads and cylinder blocks are cast with grey cast iron with following compositions: carbon 2.7-3.8%, silicon 1.0-2.2%, manganese 0.3-

1.2%, phosphorus 0.02-0.1%, sulphur 0.04-0.15%, tin 0.05-0.15%, with or without alloy addition of copper up to 1.5%, chromium up to 0.6% and molybdenum up to 0.6%, nitrogen 0.0095-0.0160%, some impurities and the balance of iron.

Titanium and aluminum are considered as impurities. Because of their high affinity for nitrogen, they neutralize the beneficial effect of nitrogen and also create problems for machining due to the super hard titanium nitrides. Preferably, they are limited to less than 0.02% each. Vanadium is a similar element as Ti in cast iron. Over a certain limit of vanadium, equiaxed vanadium carbon nitrides could be precipitated. To avoid its harmful effects of neutralizing effective nitrogen and creating machining problem, its content should be lower than roughly 0.025%. The material with these compositions can be cast in green sand mould or chemical binder bounded sand mould. Because of the high nitrogen content, the strength of the material will be higher than that without nitrogen addition.

Nitrogen Control Methods

To reach a certain level of nitrogen in the melt, measurement is performed for base iron. According to the test result, the right amount of additive is determined through the known recovery. The availability of spectrometer for nitrogen measurement makes the work very easy.

Nitriding Agents

Nitrided manganese, ferromanganese, ferrosilicon and silicon nitride can be used as nitriding agents. Melt treatments with these materials do not create problem to base composition and slag. Other nitrogen rich material could also be used, however one must consider the final chemical composition and microstructure of the grey iron. Nitrided ferrovanadium and ferrochromium are such materials that could introduce too much V and Cr and create carbide problem in some cases. Nitrogen gas could be used, however, that could require higher melt temperature and also lead to a need for investment in the foundry.

Adding Method

Powders or granules or lumps of nitriding agent can be used to add into grey iron melt with one of the following methods:

1). Adding In Pouring Ladle—the material can be added on the bottom of the ladle. In order to reach uniform distribution of nitrogen in the ladle, the size of the nitriding agent should be selected according to the ladle type and the amount of iron in the ladle. Stirring the melt is necessary for some kind of ladles. Up to several minutes are needed to uniform nitrogen in a 500 kg ladle depending on the particle size of the material.

2). Adding In Transfer Ladle To Pouring Furnace—if a pouring furnace is used with a molding line, the nitriding agent can be added through the transfer ladle, just as in pouring ladle. In this case, the pouring furnace holds nitrogen treated liquid iron. There is no problem to keep the right nitrogen level in normal operation with nitrogen as the pressure gas in the furnace. For instance, treated iron could be held in a 7 ton pouring furnace for three hours without significant loss of nitrogen in a level of 130 ppm from the beginning.

3). Adding Powders In Pouring Stream—if a pouring furnace is used with a molding line but the mould is not poured continuously, stream addition method as for inoculant could be used to avoid holding the treated iron too long time. Material powders with particle size up to for example 1.5 mm are suitable for this process.

4). Adding By In-Mould Method—a high nitrogen recovery could be achieved by the so called in-mould method. As used in ductile iron and CGI production, a reaction chamber is designed with the pouring system where nitrogen treatment takes place with the same principle as for ductile iron and CGI.

5). Powder Injection And Wire Feeding—these are the most expensive addition methods in production of a foundry, however these methods enable very high recoveries of nitrogen and excellent reproducibility.

It is not advisable to add nitrogen carrier directly into the melting furnace. In that case there is a risk for loss of nitrogen in the melting process and process control will be complicated.

Effect Of Nitrogen On The Properties Of Grey Iron

1). Tensile Strength And The Nitrogen Levels—one example on the relation between tensile strength (Rm, Mpa) and nitrogen content (N %) is shown in FIG. 1. The data are from 12 mm test bars machined from 100 mm thick test plates. The melt was from cupola in production and the base composition for those tests are roughly the same. The melt was treated by nitrided manganese in ladle. According to these results, when the nitrogen content is lower than roughly 105 ppm, tensile strength increases rapidly with the increase of nitrogen content. Thereafter, further increasing nitrogen leads to less rapid increase of the strength. This finding is very important for production control and provides the ground to achieve constant quality with regard to nitrogen content and variation of the strength. To minimize the strength variation and achieve maximum strength the preferred nitrogen content should be higher than roughly 105 ppm for this example.

FIG. 1 also indicates the negative effect from nitrogen. For this example, when the nitrogen content is higher than 160 ppm, porosity was formed in the casting. Consequently the strength starts to drop with further increase of nitrogen as shown by the trend line in the figure. Therefore the present finding is to increase nitrogen content to the range of 95 to 160 ppm, depending on the requirement on mechanical properties and the section thickness of the casting. The nitrogen saturation in liquid grey iron is related to iron composition such as C, Si, Cr. The same addition level to iron with low carbon, silicon can lead to high recovery because reduction of these elements increases the solubility of nitrogen in liquid iron. However this could also increase the risk for fissure defect because the degree of super saturation is hence increased when solidified.

Figure 2:
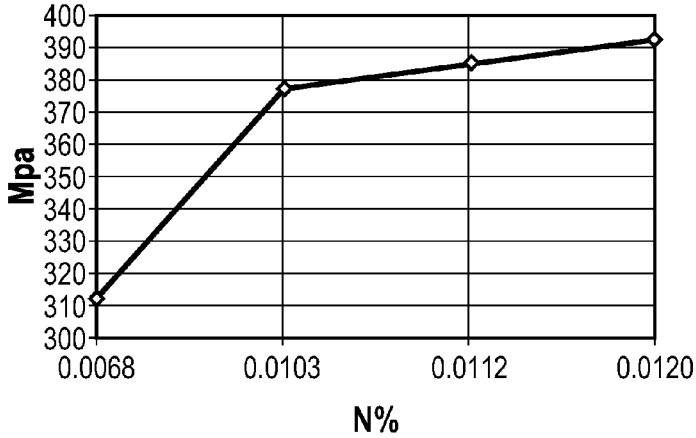
FIG. 2 is a diagram showing a tensile strength increase by nitrogen from a cylinder head casting.

Tensile strength data from the fire deck of a cylinder head is shown in FIG. 2. The weight of the casting is 160 kg. The mould is chemical binder bonded with water cooling as described in the so called FPC process (see for example U.S. Pat. No. 6,422,295). The result shown in FIG. 2 involved also other modifications than nitrogen, that is not included in this application. Another cylinder head casting with a weight of 180 kg confirmed a similar effect of nitrogen. The tensile strength increase by the extra nitrogen is 10-20% depending on base composition of the cylinder head casting. Another example is a 12 liter diesel engine block casting produced in green sand mold. By increasing the nitrogen from 60-80 ppm to 95-150 ppm, the tensile strength in the main bearing area of the block was increased by 10-20%.

A large number of cylinder head and block castings demonstrated that best benefit is achieved when the nitrogen content is higher than roughly 95 ppm.

2). Fatigue Strength

The tension and compression fatigue test showed that the relation between fatigue and tensile strength of the nitrogen treated grey iron casting follows the rule of thumb with a coefficient of 0.3. This revealed that increasing strength by nitrogen addition is better than the traditional alloy addition where tensile strength is increased more than that of fatigue, most likely because of the carbides in the microstructure.

3). Thermal Conductivity

Thermal conductivity is slightly decreased up to several percents depending on the nitrogen contents. This comes from the nitrogen effects of the slightly short graphite flakes and the slight reduction of free graphite by the promotion of pearlite formation. It is possible to keep a high thermal conductivity value after nitrogen addition by adjusting the base composition of the grey iron.

4). Thermal Expansion Coefficient

Test results showed that the thermal expansion coefficient of the casting is not affected by the addition of nitrogen.

The Effect Of Nitrogen On The Microstructure Of Grey Iron

1). Graphite

The reported compaction of graphite by nitrogen is observed. However, the degree of compaction is mild in cylinder head and cylinder block castings because of the thin section thickness, consequently the high solidification rate of the castings.

2). Matrix

Nitrogen addition enhances pearlite formation and refines the pearlite of the engine castings. However, up to 0.016% nitrogen is not enough to eliminate free ferrite on the casting surface and areas with undercooled graphite in our foundry. Therefore tin is still necessary to eliminate free ferrite in cylinder head and block castings. Under 0.04% Sn, the effect is not enough for those castings. Over 0.15% there is a risk to embrittle the iron.

The risk to have white solidification by the effect of nitrogen addition was not observed even at high nitrogen levels when with proper inoculation.

Reducing Property Variation By Controlling N, Ti, Al, V And Other Elements Forming Metal Carbon Nitrides - Higher strength is one of the effects by nitrogen addition. Moreover, according to the present result, nitrogen variation is one of the main factors for strength variation with the same basic compositions in most of the foundry production. The variation of tensile strength is less at higher nitrogen contents in accordance to this invention than at normal production contents with the same amount of nitrogen variation.

When treating the iron with the same amount of nitrogen, the resulting strength will not be the same if the Al, Ti and V contents vary, because of their neutralization effect. In order to reduce the property variation it is necessary to control Al, Ti and V contents when adding nitrogen.

As a summary, the present finding is not only controlling the nitrogen content from charge material but also adding nitrogen to the melt intentionally. The best nitrogen level is not 80-100 ppm as reported by C. Atkin in Nitrogen in iron, Foundry World, Fall, 1 (1979), 43-50. For engine cylinder head and block castings, the nitrogen content can be extended up to 0.0160%, and preferably into the range of 105-145 ppm. Tin is a very important element to achieve ferrite free castings in the combination with other elements in this invention. The contents of Ti, Al, V and other neutralizing elements should be limited to achieve best results.

What is claimed is:

1. An engine cylinder block casting fabricated from an alloy comprising, by weight: 2.7-3.8 percent carbon; 1.0-2.2 percent silicon; 0.3-1.2 percent manganese; 0.02-0.1 percent phosphorus; 0.04-0.15 percent sulphur; as much as 1.5 percent copper; as much as 0.6 percent chromium; as much as 0.6 percent molybdenum; less than 0.02 percent aluminum; less than 0.02 percent titanium; less than 0.025 percent vanadium; and nitrogen and balance up to 100 percent of iron and impurities, wherein the nitrogen content of the alloy is in the range of 0.0095-0.0160 percent and the tin content of the alloy is in the range of 0.05-0.15 percent and the alloy has a tensile strength of about 260 MPa to about 300 MPa.

2. An engine cylinder block casting made of a substantially pearlitic grey cast iron alloy, said alloy comprising: carbon, silicon, manganese, phosphorus, sulphur, tin, copper, chromium, molybdenum and nitrogen; said nitrogen content of the alloy is in the range of 0.0095-0.0160 percent; said tin content of the alloy is in the range of 0.05-0.15 percent; and the alloy has a tensile strength of about 260 MPa to about 300 MPa.

3. The casting as recited in claim 2, wherein the nitrogen content of the alloy is in the range of 0.0105-0.0145 percent.

4. The casting as recited in claim 2, wherein the carbon content of the alloy is in the range of 2.7-3.8 percent.

5. The casting as recited in claim 2, wherein the silicon content of the alloy is in the range of 1.0-2.2 percent.

6. The casting as recited in claim 2, wherein the manganese content of the alloy is in the range of 0.3-1.2 percent.

7. The casting as recited in claim 2, wherein the phosphorus content of the alloy is in the range of 0.02-0.1 percent.

8. The casting as recited in claim 2, wherein the sulphur content of the alloy is in the range of 0.04-0.15 percent.

9. The casting as recited in claim 2, wherein the alloy comprises up to 0.025 percent vanadium.

10. An engine cylinder head casting fabricated from an alloy comprising, by weight: 2.7-3.8 percent carbon; 1.0-2.2 percent silicon; 0.3-1.2 percent manganese; 0.02-0.1 percent phosphorus; 0.04-0.15 percent sulphur; as much as 1.5 percent copper; as much as 0.6 percent chromium; as much as 0.6 percent molybdenum; less than 0.02 percent aluminum; less than 0.02 percent titanium; less than 0.025 percent vanadium; and nitrogen and balance up to 100 percent of iron and impurities, wherein the nitrogen content of the alloy is in the range of 0.0095-0.0160 percent and the tin content of the alloy is in the range of 0.05-0.15 percent and the alloy has a tensile strength of about 260 MPa to about 300 MPa.

11. An engine cylinder head casting made of a substantially pearlitic grey cast iron alloy, said alloy comprising: carbon, silicon, manganese, phosphorus, sulphur, tin, copper, chromium, molybdenum and nitrogen; said nitrogen content of the alloy is in the range of 0.0095-0.0160 percent; said tin content of the alloy is in the range of 0.05-0.15 percent; and the alloy has a tensile strength of about 260 MPa to about 300 MPa.

12. The casting as recited in claim 11, wherein the nitrogen content of the alloy is in the range of 0.0105-0.0145 percent.

13. The casting as recited in claim 11, wherein the carbon content of the alloy is in the range of 2.7-3.8 percent.

14. The casting as recited in claim 11, wherein the silicon content of the alloy is in the range of 1.0-2.2 percent.

15. The casting as recited in claim 11, wherein the manganese content of the alloy is in the range of 0.3-1.2 percent.

16. The casting as recited in claim 11, wherein the phosphorus content of the alloy is in the range of 0.02-0.1 percent.

17. The casting as recited in claim 11, wherein the sulphur content of the alloy is in the range of 0.04-0.15 percent.

18. The casting as recited in claim 11, wherein the alloy comprises up to 0.025 percent vanadium.

* * * * *